United States Patent [19]

Buffkin et al.

[11] 4,034,416

[45] July 12, 1977

[54] DIVING HELMET BREECH RING CONNECTION

[75] Inventors: William R. Buffkin; William W. McCrory, both of Panama City, Fla.

[73] Assignee: The United States of America as represented by the Secretary of the Navy, Washington, D.C.

[21] Appl. No.: 734,833

[22] Filed: Oct. 22, 1976

[51] Int. Cl.[2] ..... B63C 11/04

[52] U.S. Cl. ..... 2/2.1 R; 285/283

[58] Field of Search ..... 2/2.1 R, 2.1 A; 285/283, 325, 403, 404, 73, 18, 7

[56] References Cited

U.S. PATENT DOCUMENTS

| | | | |
|---|---|---|---|
| 1,307,921 | 6/1919 | Niehoff | 2/2.1 R |
| 1,913,246 | 6/1933 | Saine | 285/403 X |
| 3,112,130 | 11/1963 | Miller | 2/2.1 A X |
| 3,488,771 | 1/1970 | Chase et al. | 2/2.1 R |
| 3,574,862 | 4/1971 | Jones | 2/2.1 R |
| 3,584,313 | 6/1971 | Brown et al. | 2/2.1 R |
| 3,815,941 | 6/1974 | Snyder | 285/283 |

FOREIGN PATENT DOCUMENTS

| | | | |
|---|---|---|---|
| 479,939 | 7/1949 | Canada | 285/283 |
| 964,822 | 5/1957 | Germany | 285/283 |

*Primary Examiner*—Alfred R. Guest
*Attorney, Agent, or Firm*—Richard S. Sciascia; Harvey A. David

[57] ABSTRACT

A connection for releasably securing a diving helmet to a suit through the use of nestable upper and lower ring members having mating cylindrical portions sealed by an O-ring. A tongue and slot serve to orient the helmet during donning and cooperate with two sets of pintles and gudgeons disposed 120° from one another to secure the ring members together.

7 Claims, 4 Drawing Figures

DIVING HELMET BREECH RING CONNECTION

BACKGROUND OF THE INVENTION

This invention relates to divers' suits and more particularly to improvements in the separable connection made between a diver's helmet and the body covering portion of the suit.

Conventional diving helmets are connected to the fabric suit by means of a breastplate comprising a series of studs which extend outwardly through the metal straps. Wing nuts are applied to the studs to clamp the fabric between the metal straps and the breastplate. The breastplate includes a circular opening through which the diver's head extends and which is provided with external interrupted threads. The helmet has corresponding internal interrupted threads and is secured by rotation of the helmet and then is locked against rotation by a suitable latch. The conventional helmet/-breastplate combination requires considerable dressing and undressing time, is expensive to manufacture, requires rotation of the helmet to effect coupling, is often uncomfortable, is heavy, and is often subject to leakage.

With the advent of more sophisticated diving equipment, including both surface supported and self-contained sytems that are designed to give the wearer greater freedom and ease of movement, lighter, more comfortable, easier operated, and more reliable helmet to fabric breech ring connections have been needed.

A variety of quick operating, light weight, helmet to suit connections have been devised, a number of which were meant principally for pressurized space or flight suit use. While these may have limited utility for underwater use they are generally more complex and less rugged than is desirable for use by a working diver. In this regard, a significant factor in the design of divers' suits is the fact that the worst conditions of use must be anticipated and experience has shown that these include prolonged exposure to salt water, sand or grit, and abusive handling, the latter not so much by negligence as by the result of the severe operating and working conditions met in salvage or military endeavors. Accordingly, it has been found that elements such as spring operated plungers, cams, levers and the like are prone to being bent, broken, or jammed.

Moreover, some of the prevailing helmet to suit connections require rotation of the helmet in order to effect the connection. In order to reduce bouyancy of helmets to a substantially neutral state while preserving lightness through the use of modern plastics and metals, it is necessary to make the interior of the helmet fit the wearer's head so closely that rotation of more than a few degrees in ruled out.

SUMMARY OF THE INVENTION

With the foregoing in mind, it is a principal object of the invention to provide an improved helmet to suit connection or breech ring construction that avoids most or all of the disadvantages of the prior art for diving use.

Another object is the provision of a novel helmet to suit separable connection that avoids the need for helmet rotation about its vertical axis.

Still another object of the invention is the provision of a rugged, simple, light weight, and yet reliable connection of the foregoing character.

As another object the invention aims to provide a diver's helmet breech ring construction that will retain its watertight integrity even though only partially secured.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
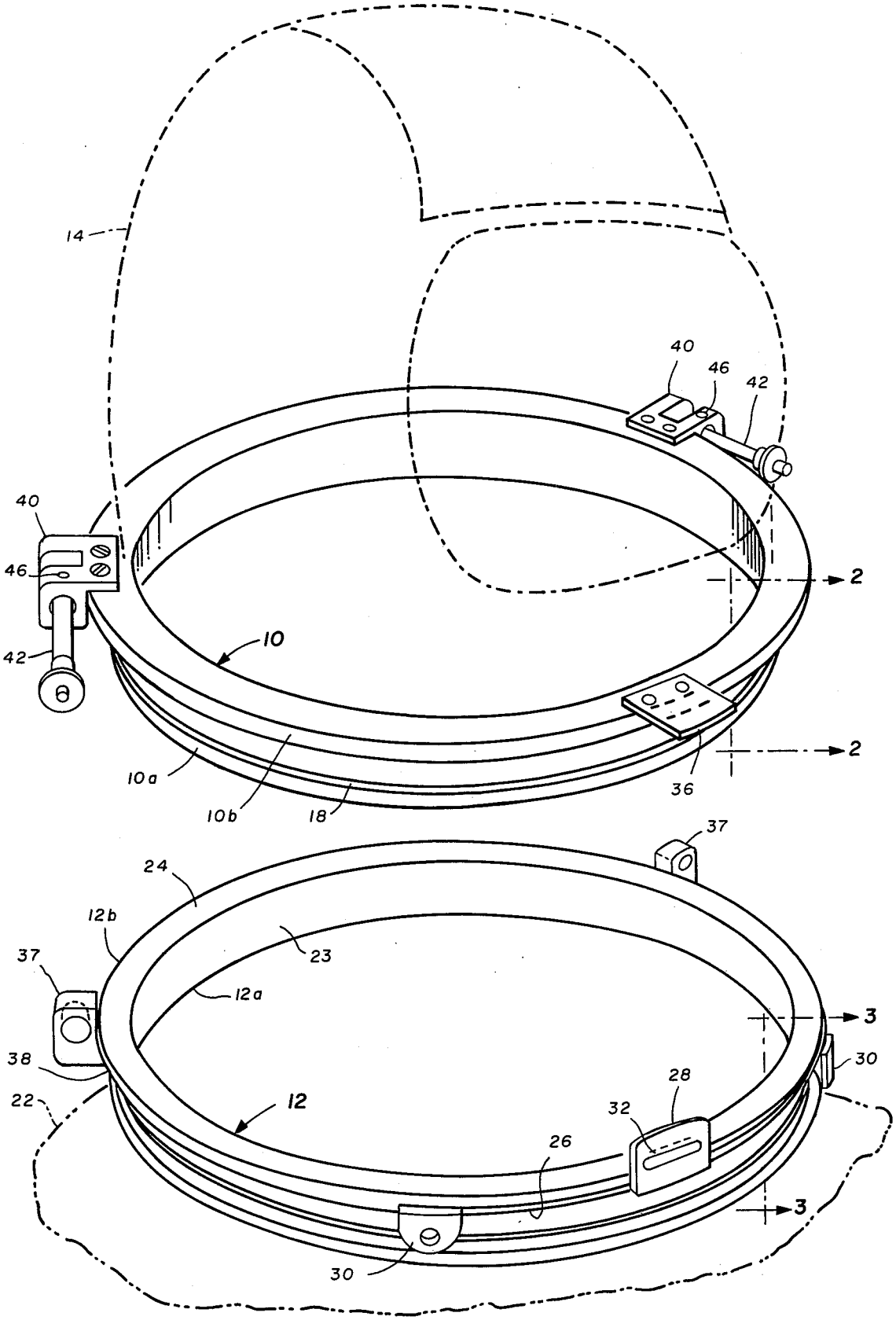
FIG. 1 is a perspective view of a helmet to suit breech ring connector embodying the invention, illustrating the upper and lower ring members thereof in separated condition, and depicting an associated helmet and suit protion in phantom.
Figure 2:
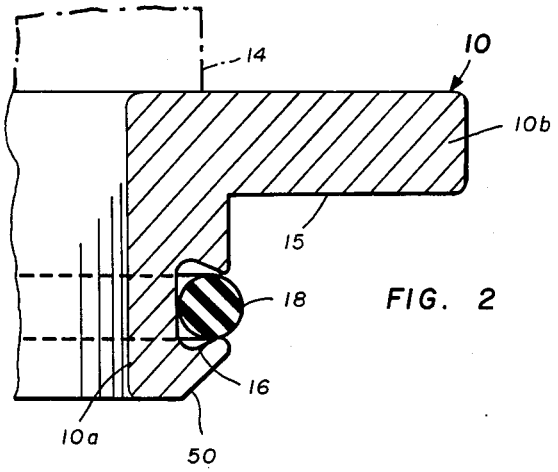
FIG. 2 is an enlarged sectional view of the upper ring member taken substantially along line 2—2 of FIG. 1.

In accordance with this invention, and referring first to FIG. 1, a helmet-to-suit connection is made by coupling of an upper or helmet breech ring 10 with a lower or suit breech ring 12. Ring 10, formed of a corrosion resistant metal, is fixed to a suitable helmet 14, at the lower edge thereof, and is angular in section as is best shown in FIG. 2. Thus, a vertical, cylindrical portion **10*a* depends from a horizontal, outwardly extending flange portion 10*b*. That flange portion presents a downwardly directed annular surface 15. An annular groove 16 is formed in the outer surface of cylindrical portion 10*a*, and carries an elastomeric 0-ring 18. Groove 16 is undercut and trapezoidal in section, to allow space for 0-ring 16 when compressed radially inwardly of ring 10**.

Figure 3:
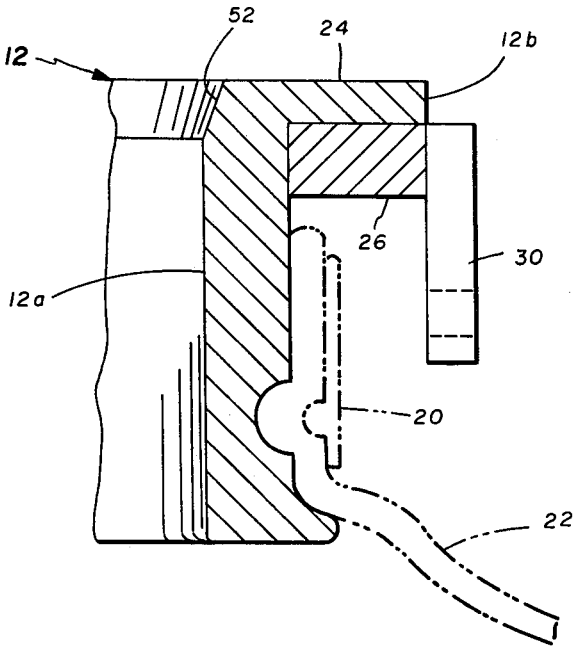
FIG. 3 is an enlarged sectional view of the lower ring member taken substantially along line 3—3 of FIG. 1.

The breech ring 12 is adapted to be fixed, by a quick closing/releasing flexible metal band 20 (not forming part of this invention), in the neck portion of a suit 22. Ring 12 is angular in section, as best shown in FIG. 3, having a vertical cylindrical portion **12*a* depending from a horizontal, outwardly extending flange portion 12*b*. The lower breech ring 12 has a cylindrical opening or bore 23 of sufficient size, of course, to pass over a wearer's head, and presents an upwardly directed annular surface 24 against which annular surface 15 of ring 10** is adapted to be superimposed.

Flange portion 12b is undercut to receive an arcuate bar 26, from the center of which is an upstanding plate 28, and from the ends of which bar are depending eye members 30. Plate 28 has a horizontal slot 32 formed therein, adapted to receive a tongue 36 mounted on flange **10*b* of the helmet breech ring 10**.

Figure 4:
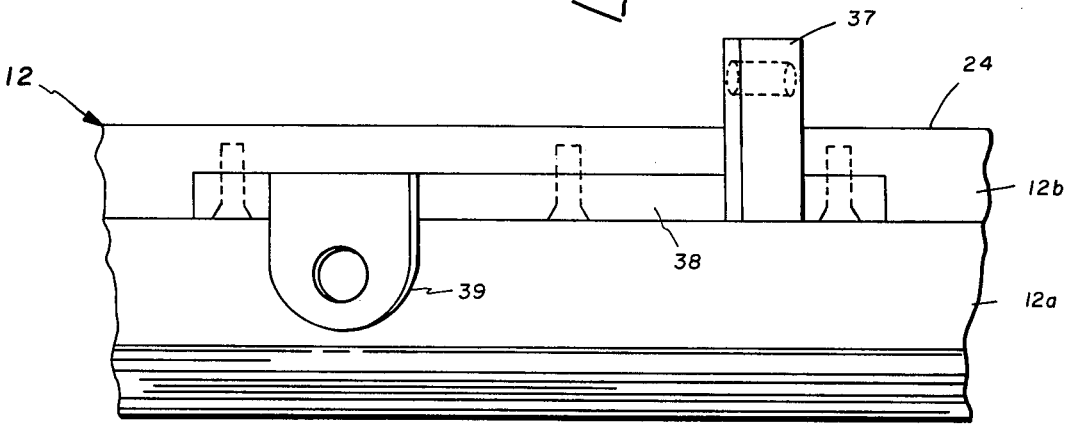
FIG. 4 is a rear, fragmentary elevational view of a portion of the lower ring member.

A pair of upstanding gudgeon members 37 are mounted so as to extend above flange 12b and are adapted to be received in the slots of bifurcated gudgeon members 40 mounted on flange 10b of ring 10. These gudgeon members 37 are each carried by an arcuate bar 38 fixed, as shown in FIG. 4., to the flange **12*b* of ring 12. Each bar 38 also carries a depending eye member 39. Gudgeon member 40 are provided with pintles 42 that are adapted to slide through gudgeon members 37. Pintles 42 are advantageously of the type having push button releasable detents, and are captivated against complete removal from gudgeon members 40. Thus, pins 46 in gudgeon members 40 cooperate with recesses or flats on the sides of pintles 42** to permit limited movement thereof.

To don the helmet, it is lowered over the diver's head until tongue 36 is adjacent plate 28. The helmet is tilted slightly toward plate 28 until tongue 36 can be inserted into slot 32. The helmet is then straightened, causing ring 10 to pivot about the tongue and slot so that cylindrical portion 10a is neatly received within cylindrical portion 12*a* of ring 12, and flange 10*b* is seated against flange 12*b*. Pintles 42 are then pressed inwardly to lock gudgeon members 37 to gudgeon members 40. The pintles and gudgeons and the tongue slot provide connections between the rings at three locations separated by 120° from one another. In the event of failure of any one of those connections, the remaining two are adequate to prevent displacement of the helmet.

It will be noted that O-ring 18 will cooperate with the inner surface of cylindrical portion 12a. Although it has been proven unnecessary, a second O-ring or other gasket can be incorporated between flanges 10*b* and 12*b*. It will also be noted that ring 10 has a 45° chamfer at 50, while ring 12 has a 15° chamfer at 52. These permit the necessary slight tilting of helmet 14 with the tongue engaged.

Eye members 30, 39 are used to support suitable strap hangers for straps used in jocking the helmet/suit assembly down against tendencies thereof to float upwardly from the shoulders of the diver.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A breech ring connector for removably securing a helmet to a suit, said breech ring connector comprising:

an upper ring member, adapted to be fixed to the lower edge of a helmet, said upper ring member comprising a first cylindrical portion depending from a first outwardly extending flange portion and defining a central opening for receiving the head of a wearer, a lower ring member, adapted to be fixed in the neck opening of a suit, said lower ring member comprising a second cylindrical portion depending from a second outwardly extending flange portion and defining a substantially cylindrical opening;

said upper ring member being nestable with said lower ring member with said first cylindrical portion disposed within said cylindrical opening of said lower ring member and said first flange portion overlying said second flange portion;

an elastomeric ring carried by one of said first and second cylindrical portions for effecting sealing therebetween when said first ring member is nested with said second ring member;

a slotted plate extending upwardly from the outer edge of said lower ring member;

a tongue extending radially from the outer edge of said upper ring member for cooperating pivotal engagement with said slotted member;

first and second locking means, each disposed substantially 120° from said tongue and said slotted plate and from one another, for releasably securing said upper and lower ring members together.

2. A breech ring connector as defined in claim 1, and wherein said first and second locking means each comprise:

a first gudgeon member extending from said upper ring member;

a second gudgeon member extending from said lower ring member, said gudgeon members having aligned apertures when said upper and lower ring members are nested; and a pintle reciprocable in said aligned apertures between first and second aperative positions for securing together and releasing said first and second gudgeons and the respective ring members.

3. A breech ring connector as defined in claim 2, and wherein: said upper ring member is characterized by a groove in the outer surface of said first cylindrical portion, said groove being substantially trapezoidal in section; and said elastomeric ring is circular in section and is retained in said groove.

4. A breech ring connector as defined in claim 2, and wherein:

the lower, outer edge of said first cylindrical portion is characterized by a chamfer of about 45°.

5. A breech ring connector as defined in claim 4, and wherein:

the upper edge of said cylindrical opening of said lower ring member is characterized by a chamfer of about 15°.

6. A breech ring connector as defined in claim 5, and wherein:

said upper ring member is characterized by a groove in the outer surface of said first cylindrical portion, said groove being substantially trapezoidal in section; and said elastomeric ring is circular in section and is retained in said groove.

7. A breech ring connector as defined in claim 6, and further comprising:

means for preventing complete withdrawal of said pintles from said gudgeons.

* * * * *